US008302768B2

(12) United States Patent
Sibley

(10) Patent No.: US 8,302,768 B2
(45) Date of Patent: Nov. 6, 2012

(54) AMMUNITION PRESERVATION PACKAGING AND STORAGE SYSTEM

(75) Inventor: David P. Sibley, Twin Falls, ID (US)

(73) Assignee: Ready Reserve Ammo, Inc., Twin Falls, ID (US)

( * ) Notice: Subject to any disclaimer, the term of this patent is extended or adjusted under 35 U.S.C. 154(b) by 0 days.

(21) Appl. No.: 13/010,547

(22) Filed: Jan. 20, 2011

(65) Prior Publication Data

US 2011/0174639 A1 Jul. 21, 2011

Related U.S. Application Data

(60) Provisional application No. 61/296,825, filed on Jan. 20, 2010.

(51) Int. Cl.
*F42B 39/00* (2006.01)
*B65D 85/00* (2006.01)
*B65D 81/20* (2006.01)

(52) U.S. Cl. ..... 206/3; 89/34; 206/213.1; 206/524.8; 220/62.15

(58) Field of Classification Search ..... 206/3, 205, 206/213.1, 524.8; 220/62.11, 62.15; 89/34
See application file for complete search history.

(56) References Cited

U.S. PATENT DOCUMENTS

| | | | | |
|---|---|---|---|---|
| 2,018,682 | A * | 10/1935 | McConkie | 220/62.13 |
| 2,356,969 | A * | 8/1944 | Blum | 206/3 |
| 2,636,638 | A * | 4/1953 | Dobbins | 220/274 |
| 2,653,730 | A * | 9/1953 | Fitch | 220/274 |
| 3,510,376 | A * | 5/1970 | Douglas et al. | 206/3 |
| 3,559,872 | A * | 2/1971 | Riboud | 206/3 |
| 4,066,401 | A * | 1/1978 | Solomon | 206/205 |
| 7,416,076 | B2 * | 8/2008 | Barton et al. | 206/3 |

* cited by examiner

*Primary Examiner* — Bryon Gehman
(74) *Attorney, Agent, or Firm* — Richard D. Clarke

(57) ABSTRACT

The present invention provides a unique method of manufacturing an inexpensive, hermetically sealed ammunition container by the use of a conventional canning operation where the ammunition is inserted into cans that have been enamel coated inside and out and placed between resilient cushioning plugs and put into a vacuum chamber. Optionally, all of the air, atmosphere/oxygen and atmospheric moisture that may be present in the can is removed and replaced with an inert gas before the can is sealed. This packaging system fulfills the need for a method of storing ammunition over an extended period of time, and provides a convenient, air tight and compact package for ammunition and related components.

30 Claims, 3 Drawing Sheets

AMMUNITION PRESERVATION PACKAGING AND STORAGE SYSTEM

FIELD OF THE INVENTION

This application provides a unique method of manufacturing an inexpensive, hermetically sealed ammunition container. In particular, a hermetically sealed container can be used to preserve, package, and store ammunition, and ammunition components such as primers, shot, bullets, projectiles, shells, casings, and gun powder.

BACKGROUND OF THE INVENTION

There has consistently been a need for a method of storing ammunition over an extended period. Ammunition sold to the public is normally sold in unsealed containers made from cardboard, plastic or metal. Ammunition sold to the military is usually subject to more stringent requirements, but these containers are not adequately hermetically sealed for an extended period. An adequate long-term sealing method requires the evacuating of the air and moisture in the container and replacing it with an inert gas before sealing of the container. If the casings of the ammunition were to come in contact with dissimilar metals, electrolysis will accrue damaging the shell casings so the ammunition must be additionally fully cushioned. The powder used in ammunition has the ability to degrade after an extended period of inadequate storage affecting its usefulness. Often a desiccating material is put in the containers to minimize the moisture but this does not adequately protect the ammunition for extended periods. Cosmoline (grease), for many years, has been used to preserve and protect numerous military related items for extended periods, but cannot be used effectively for ammunition because it would have to be cleaned before being used.

Numerous innovations for a hermetically sealed ammunition container have been provided in the prior art that are described as follows. Even though these innovations may be suitable for the specific individual purposes to which they address, they differ from the present design as hereinafter contrasted. The following is a summary of those prior art patents most relevant to this application at hand; as well as a description outlining the difference between the features of the hermetically sealed ammunition container and the prior art.

U.S. Pat. No. 4,942,991 of Robert M. Lyons describes a portable container for storing rounds of ammunition and which includes a housing having a plurality of separately partitioned resilient round supporting pads which function to safely, quietly and cooperatively retain the ammunition within the container and which progressively and partially eject the ammunition as the lid of the container is opened.

This patent describes a portable container for storing rounds of ammunition on a temporary basis. It has not been designed for an inexpensive, hermetically sealed, sales container for long term storage of ammunition.

U.S. Pat. No. 6,460,694 of Vishwa Khanna et al. tells of a container that is a spirally-wound, laminated, and cylindrically shaped is capable of protecting a mortar or other round from a large number of environmental conditions. The laminate material includes a layer of low-density polyethylene (LDPE) heat-bonded to a Kraft paper, and is both durable, strong, and moisture-resistant. During the container manufacturing process, multiple layers of the laminate material, augmented by one or more layers of aluminum foil, are wound in a spiral fashion over an interior cylinder of ammunition container board, using conventional tooling and machinery. Layers of the cylinder are bonded to their contiguous neighbors by adhesive. The ends of the containers are sealed with crimped metal end caps, affecting a durable and moisture-resistance seal and giving the cylinder added crush-resistance. The construction of the container requires no high temperature operations, produces no noxious fumes, and does not expose workers to hazardous or toxic materials. In addition, there is less waste as compared to the current technology.

This patent tells of a of a container that is a spirally-wound, laminated, and cylindrically shaped is capable of protecting a single mortar shell or other round from a large number of environmental conditions. This invention has been designed for military use only and could not be used as an economical sealed container for multiple rounds of small caliber ammunition sold to the public.

U.S. Pat. No. 7,308,981 of Jeam-Franqois Noel Du Payrat et al. relates to a container for ammunition of the type comprising a case inside which an inner casing receiving the ammunition is able to slide between two axial positions, one in which it blocks the ammunition and the other in which it unblocks the ammunition, the inner casing incorporating a front sleeve having flexible fingers, such sleeve cooperating in its blocking position with a fixed limit stop integral with the case and ensuring the retention of the fingers on a zone of the projectile to limit its translation, such container wherein it incorporates means ensuring the radial spacing of the flexible fingers at a distance from the projectile in the unblocking position of the inner casing.

This patent relates to a container for single round of ammunition used for the military. It again could not be used as an economical sealed container for multiple rounds of small caliber ammunition sold to the public.

U.S. Pat. No. 7,422,102 of Yuen H. Lain et al. describes a container for an ammunition cartridge having a conical forward portion includes a generally cylindrical cap having a closed end and an open end; a generally cylindrical main body having a closed end, an open end and a wall, a thickness of the wall at the open end decreasing from a larger thickness to a smaller thickness to form a taper on an exterior surface of the wall; a latch assembly disposed in part on the cap and in part on the main body to lock the cap and the main body in position; a first gasket disposed in the cap; a second gasket disposed around the taper of the main body; a cartridge support disposed inside the main body; a pair of bosses disposed on the main body and axially separated; and a strap connecting the bosses and comprising a middle portion and two end portions, whereby when a load is applied to the middle portion the end portions are forced against the bosses.

This patent describes a container for a single ammunition cartridge and could not be used as an economical sealed container for multiple rounds of small caliber ammunition sold to the public.

None of these previous efforts, however, provides the benefits attendant with the hermetically sealed ammunition storage container and do not mention the use of an inert gas as a means of providing long-term storage. The present method of manufacturing the hermetically sealed ammunition container achieves its intended purposes, objects and advantages over the prior art devices through a new, useful and unobvious combination of method steps and component elements at a reasonable cost to manufacture, and by employing readily available materials.

In this respect, before explaining at least one embodiment of the hermetically sealed ammunition container in detail it is to be understood that the design is not limited in its application to the details of construction and to the arrangement, of the components set forth in the following description or illustrated in the drawings. The hermetically sealed ammunition container is capable of having other embodiments and of being manufactured in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other ammunition containers for carrying out the several purposes of the present design. It is important, therefore, that the claims be regarded as including such equivalent construction insofar as they do not depart from the spirit and scope of the present application.

SUMMARY OF THE INVENTION

The principal advantage of the hermetically sealed ammunition container is the capability of keeping ammunition in a safely sealed container for an extended period.

Another advantage of the hermetically sealed ammunition container is the removal of the air and moisture while keeping the ammunition stored in an inert gaseous atmosphere.

Another advantage is the reduced sizes of the hermetically sealed ammunition containers.

Another advantage is the unique method of manufacturing an inexpensive form of hermetically sealed ammunition containers that can be made in different sizes and shapes to be used with a wide variety of ammunition.

A further advantage of the hermetically sealed ammunition container is that it will eliminate the degradation of the ammunition occurring in the conventional forms of ammunition containers.

Yet another advantage of the hermetically sealed ammunition container it can use a variety of different inert gases to perform the manufacturing process.

And still another advantage of the hermetically sealed ammunition container is that it can be sealed with a variety of different lid configurations.

These together with other advantages of the hermetically sealed ammunition container, along with the various features of novelty, which characterize the design, are pointed out with particularity in the claims annexed to and forming a part of this disclosure. For a better understanding of the hermetically sealed ammunition container, its operating advantages and the specific objects attained by its uses, reference should be made to the accompanying drawings and descriptive matter in which there are illustrated preferred embodiments of the hermetically sealed ammunition container. There has thus been outlined, rather broadly, the more important features of the design in order that the detailed description thereof that follows may be better understood, and in order that the present contribution to the art may be better appreciated. There are additional features of the hermetically sealed ammunition container that will be described hereinafter and which will form the subject matter of the claims appended hereto.

The preferred method of the manufacturing process of the hermetically sealed ammunition container is to use a heavy gauge steel can with double enameling. Double enameling is a term used in the canning industry to describe a steel can that has been manufactured with an enamel coating on the inside and outside of the can. This includes the ends of the can as well. The enameling is there to prevent rusting on the inside and outside and when food is placed in the can; the food does not come into direct contact with the steel can, thus preventing the transfer of a metallic taste to the food. In the case of canning ammunition, it prevents the ammunition from coming in contact with the bare metal of the can, preventing electrolysis. Enameling serves as an insulator between the steel can and the dissimilar metals of the ammunition. It must be understood at this time that a variety of conventional coatings, along with enamel can be used for this process and will be covered within the scope of this application. Similar insulation can be achieved by utilizing a liner comprised of paper, cardboard, plastic, rubber, or any spray on electrical insulation. Most ammunition is comprised of three different metals; brass, lead, and copper. In some cases steel and other metals are used. If any of these metals were allowed to come in contact with the bare steel of the can, electrolysis would commence, causing corrosion and degradation of the ammunition stored inside the can. This application is not limited to a round steel can, but can come in a variety of different shapes. Other containers or vessels of any size or shape are to be included within this application, examples are; glass, plastic, composites, fiberglass, and any other container vessels and are covered within the scope of this application.

Before the ammunition is portioned into the can, a firm, resilient foam cushioned "plug," is placed in the can and pushed to the bottom. This plug is a "push fit" inside the can. One or more rounds of ammunition can be contained within the hermetically sealed ammunition container. The ammunition is then portioned into the can and another plug is placed on top of the ammunition, this plug has a small vent orifice in the center. These plugs can vary in thickness to fill the void between the ammunition and the ends of the can. They serve two purposes; as a filler of the void left by the ammunition in the can (the can isn't always full of ammunition), they act as a shock absorber and sound deadening. If you shake the can, the ammunition will not rattle against the ends of the can. The ammunition is not free to move inside the can with the plugs in place. When the can is opened, the user will remove the top plug, exposing the ammunition underneath. The ammunition to be canned includes all calibers be it rifle, pistol, shotgun, tracers, machine gun rounds, and ammunition related components, such as brass, primers and bullets, as well as gun powder.

Once the can has been filled with a bottom plug, ammunition, and a top plug with a vent hole, it is then optionally placed into a vacuum chamber. The chamber doors are closed and a vacuum of approximately 29 inches of mercury is drawn on the chamber. This removes all of the atmosphere/oxygen and atmospheric moisture that may be present in the can through the vent orifice in the top plug. With the preferred embodiment, the vacuum is halted and the chamber is then flooded with an inert gas, such as gaseous nitrogen. The gas is inert and dry, creating a benign atmosphere inside the can and around the ammunition. This dry, inert environment now created inside the can will halt corrosion, degradation, and deterioration of the ammunition. The shelf life/storage time created by this process should give the ammunition stored inside the can almost an unlimited life regardless of the environment outside the can. This application is not limited to gaseous nitrogen. Alternate embodiments can include liquid nitrogen, oxygen absorbers along with other inert gases such as carbon dioxide, helium, and argon. Any process used to create an inert/benign atmosphere inside the ammunition container will be covered within the scope of this application.

After the optional evacuation/flooding process is complete the chamber doors are opened and the can, filled with nitrogen, is pushed out and immediately run through a commercial canning machine where a pop top lid is applied and sealed to the can. The nitrogen gas that is in the can at this time is very heavy, dense, and cold and is not naturally trying to diffuse into the air in the room allowing for a reasonable amount of time to apply a lid and seal the can. This lid is not limited to a pop-top or a foil pull-tab but can include a solid can end that requires a can opener to open. A pop-top lid has a pull-tab to open, similar to one found on a peanut can or Pringles and requires no tools to open. The pop-top can lid opener is the preferred embodiment to be use in this process.

The can is also supplied with a plastic reusable cover/cap. This cap is to be placed on the can after it is opened to provide some protection for the exposed ammunition that may remain in the can after use. This cap is similar to the cap/lid used to reseal a coffee can once opened. This application is not limited to a plastic cap but is to include any method used to reseal or protect the vessel, such as a screw on lid.

With respect to the above description then, it is to be realized that the optimum dimensional relationships for the parts of this application, to include variations in size, materials, shape, form, function and manner of operation, assembly and use, are deemed readily apparent and obvious to one skilled in the art. All equivalent relationships to those illustrated in the drawings and described in the specification intend to be encompassed by the present disclosure. Therefore, the foregoing is considered as illustrative only of the principles of the hermetically sealed ammunition container. Further, since numerous modifications and changes will readily occur to those skilled in the art, it is not desired to limit the design to the exact construction and operation shown and described, and accordingly, all suitable modifications and equivalents may be resorted to, falling within the scope of this application.

BRIEF DESCRIPTION OF THE DRAWINGS

The accompanying drawings, which are incorporated in and form a part of this specification, illustrate embodiments of the hermetically sealed ammunition container and together with the description, serve to explain the principles of this application.

For a fuller understanding of the nature and advantages of the hermetically sealed ammunition container, reference should be had to the following detailed description taken in conjunction with the accompanying drawings which are incorporated in and form a part of this specification, illustrate embodiments of the design together with the description, serve to explain the principles of this application.

DETAILED DESCRIPTION OF THE PREFERRED EMBODIMENTS

Figure 1:
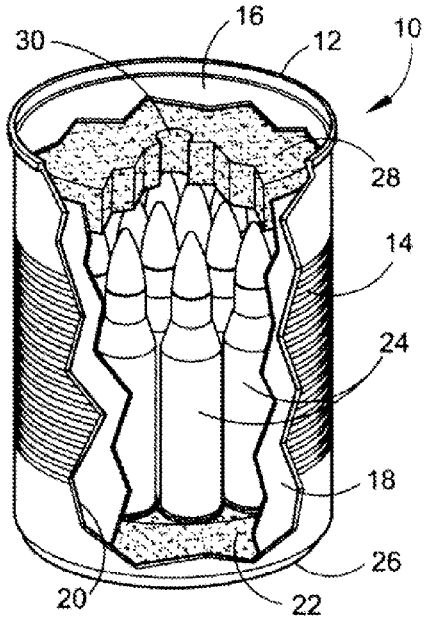
FIG. 1 depicts a perspective view of the hermetically sealed ammunition container with the side and top cut away to expose the internal components.

Referring now to the drawings, wherein similar parts of the hermetically sealed ammunition container 10 are identified by like reference numerals, there is seen in FIG. 1 a perspective view of the hermetically sealed ammunition container 10 consisting of the can 12 with the can side 14 and can top 16 cut away to expose the internal components. The optional cushioning and insulating sleeve material 18 is shown lining the can inside wall 20 of the hermetically sealed ammunition container 10 with a bottom resilient foam cushioned plug 22 cushioning the ammunition 24 at the can bottom surface 26 of the can 12. A top resilient foam cushioned plug 28 with a central orifice 30 where the inert gas is dispensed after the can has been placed in a vacuum chamber and the atmosphere/oxygen and atmospheric moisture have been removed. It should be understood that the hermetically sealed container can be used to preserve, package, and store ammunition, and ammunition components such as primers, shot, bullets, projectiles, shells, casings, and gun powder.

Figure 2:
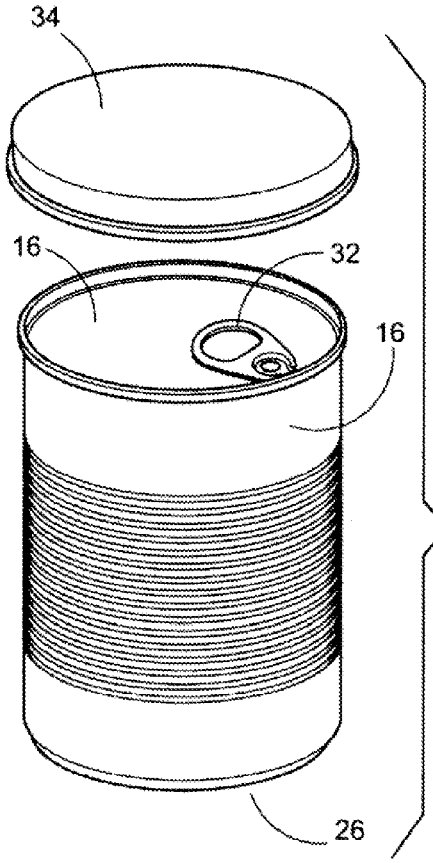
FIG. 2 depicts a view of the sealed hermetically sealed ammunition container.

FIG. 2 depicts a perspective view of the hermetically sealed ammunition container 10 with the preferred embodiment of the top 16 using a conventional pop-top can opener 32. An additional can cover 34 is illustrated above the hermetically sealed ammunition container 10 to be used after the can top 16 has been removed.

Figure 3:
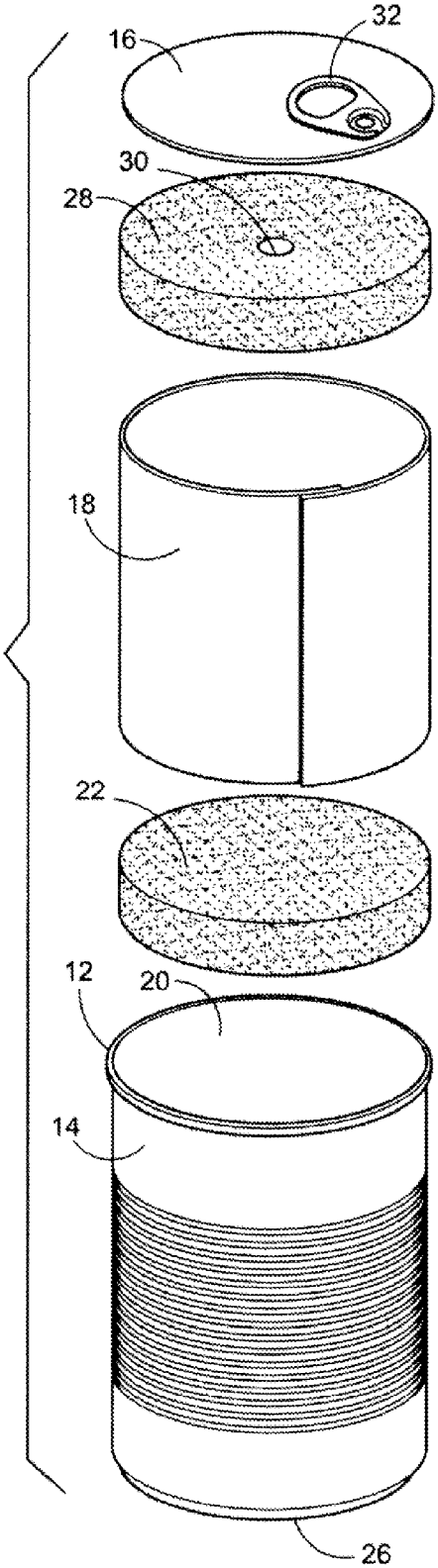
FIG. 3 depicts an exploded perspective view of the hermetically sealed ammunition container.

FIG. 3 depicts an exploded perspective view of the hermetically sealed ammunition container 10 illustrating the top 16 using the preferred embodiment of a conventional Pop-Top opener 32 above the top resilient foam cushioned plug 28 with a central orifice 30. The optional cushioning and insulating sleeve material 18 with the bottom resilient foam cushioned plug 22 above the cup 12.

Figure 4:
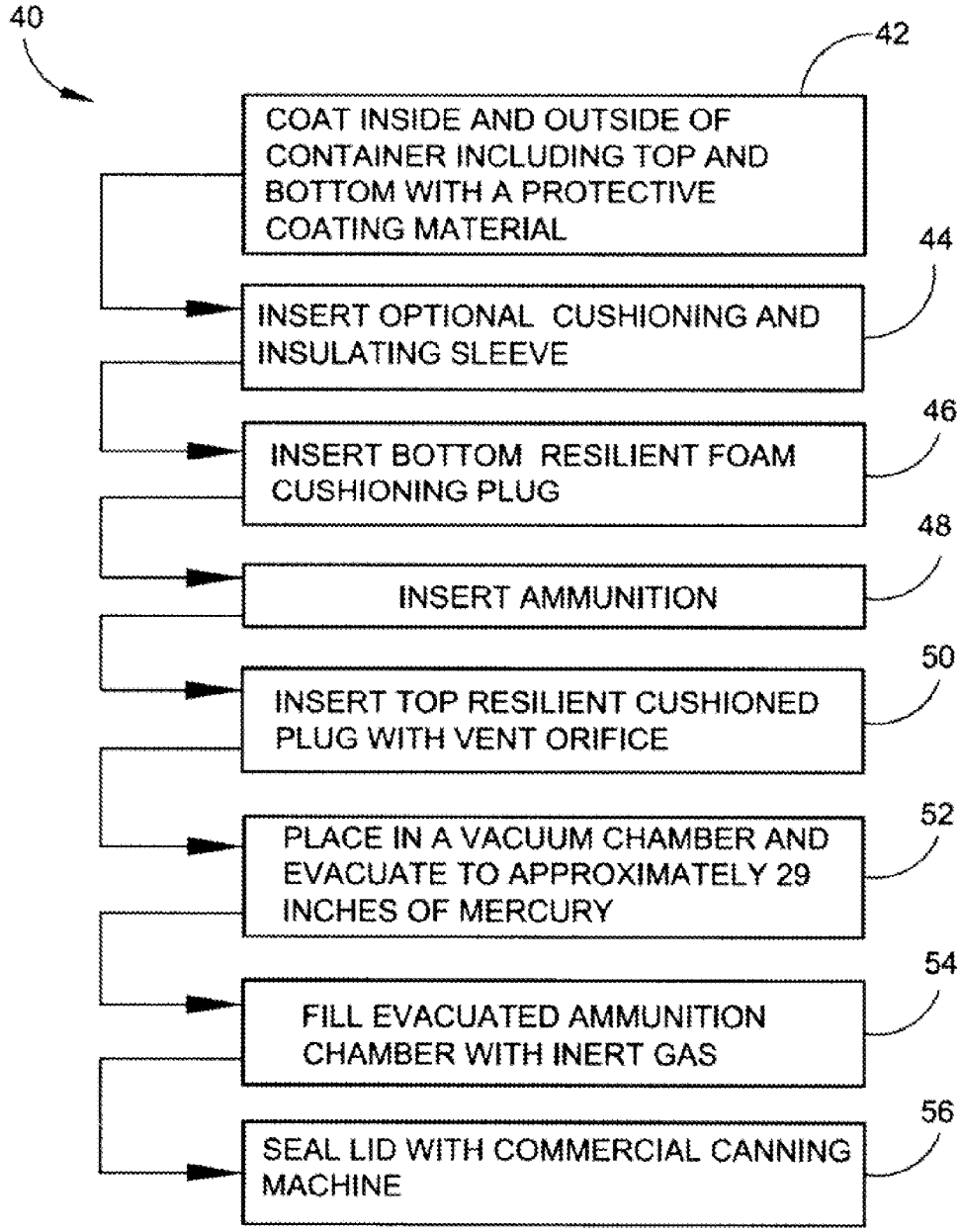
FIG. 4 depicts a block diagram of the manufacturing process of the hermetically sealed ammunition container.

FIG. 4 depicts a block diagram 40 of the manufacturing process of the hermetically sealed ammunition container 10 that illustrates the manufacturing process.

- Box 42 describes the coating of the inside and outside of the hermetically sealed ammunition container 10 including the can top 16 and the bottom 26 with a protective coating material.
- Box 44 describes the insertion of the optional cushioning and insulating sleeve material 18.
- Box 46 describes the insertion of the bottom resilient foam cushioned plug 22.
- Box 48 describes the insertion of the ammunition 24.
- Box 50 describes the insertion top resilient foam cushioned plug 28 with vent orifice 30.
- Box 52 describes the optional step of placing the filled can 12 in a vacuum chamber and evacuating it to approximately 20 to 30 inches of mercury.
- Box 54 describes the optional step of filling the ammunition chamber with an inert gas.
- Box 56 describes the sealing of the can top 16 with a commercial canning machine.

Figure 5:
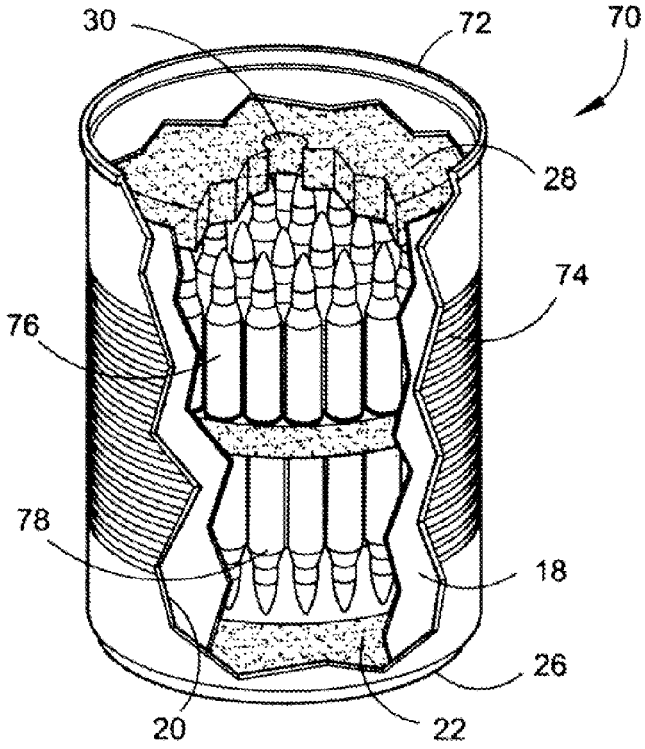
FIG. 5 depicts a perspective view of the hermetically sealed ammunition container with the side and top cut away to expose the internal components, in this case illustrating center fire ammunition packed and stored primer to primer, in two layers separated by a foam insert.

FIG. 5 depicts a perspective view of the hermetically sealed ammunition container 70 with the side 74 and top 72 cut away to expose the internal components, in this case illustrating center fire ammunition 76 and 78 packed and stored primer to primer, in two layers separated by a foam insert. The ammunition packed and preserved in this way could be center fire cartridges, shotgun shells, or the like. This type of container can be supplied with a conventional top or a pop-top type container opening mechanism, or some other easy open feature, such as a screw on lid.

Figure 6:
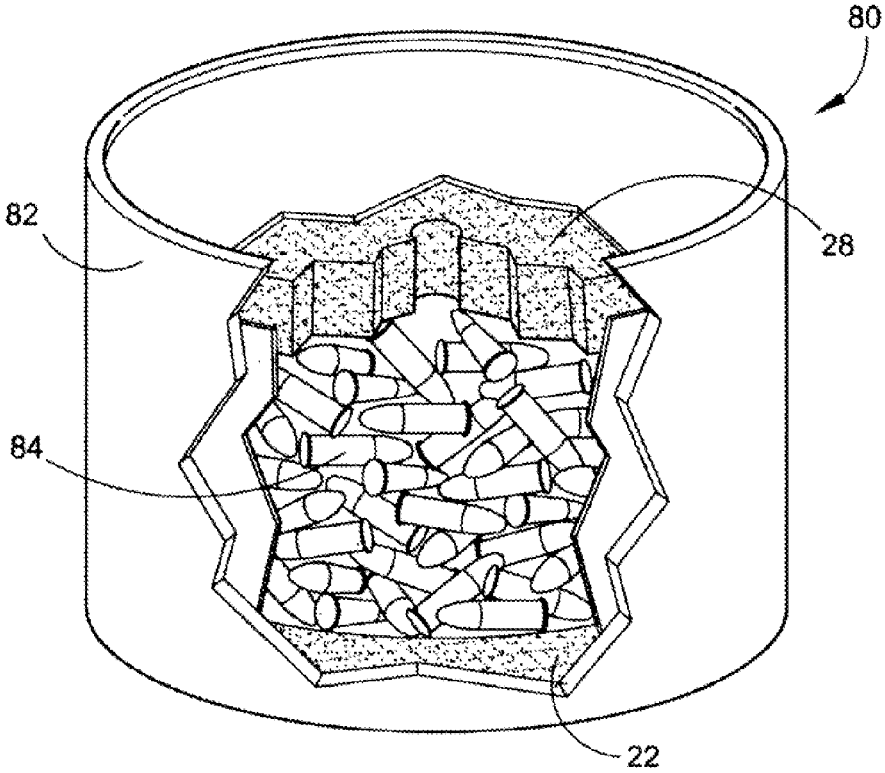
FIG. 6 depicts a perspective view of the hermetically sealed ammunition container with the side and top cut away to expose the internal components, in this case illustrating rim fire ammunition packed and stored loosely.

FIG. 6 depicts a perspective view of the hermetically sealed ammunition container 80 with the side 82 and top portions cut away to expose the internal preserved and stored components, in this case illustrating rim fire ammunition 84 packed and stored loosely. This type of container may or may not include the optional foam padding inserts 28 and 22 as shown here. This type of container, and the one shown in FIG. 5 can be used to preserve, package, and store ammunition, and ammunition components such as primers, shot, bullets, projectiles, shells, casings, and gun powder.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A preservation packaging and storage system for packaging, preserving and short or long term storage of ammunition and ammunition related components, comprising:

a) a cylindrical container having an inside surface, an outside surface, a top lid portion and a bottom floor portion, wherein said top lid portion includes a pop top container opening mechanism;

b) said container being filled with ammunition thereby generating an ammunition filled container;

c) said container filled with ammunition being air evacuated; and d) further wherein said container is hermetically sealed.

2. A preservation packaging and storage system for packaging, preserving and short or long term storage of ammunition and ammunition related components, according to claim 1, wherein said container filled with ammunition and being air evacuated is air evacuated by being placed in a vacuum chamber in which air is evacuated from the ammunition filled container to a negative pressure of about 20-30 inches of mercury.

3. A preservation packaging and storage system for packaging, preserving and short or long term storage of ammunition and ammunition related components, according to claim 2, wherein said air evacuated ammunition filled container is filled with an inert gas.

4. A preservation packaging and storage system for packaging, preserving and short or long term storage of ammunition and ammunition related components, according to claim 3, wherein said inert gas is nitrogen.

5. A preservation packaging and storage system for packaging, preserving and short or lone term storage of ammunition and ammunition related components, according to claim 1, wherein said inside surface, and said outside surface of said container are coated with a protective coating material.

6. A preservation packaging and storage system for packaging, preserving and short or long term storage of ammunition and ammunition related components, according to claim 5, wherein said protective coating material is an enamel.

7. A preservation packaging and storage system for packaging, preserving and short or long term storage of ammunition and ammunition related components, according to claim 1, wherein said top portion and said bottom portion of said container are coated with a protective coating material.

8. A preservation packaging and storage system for packaging, preserving and short or long term storage of ammunition and ammunition related components, according to claim 7, wherein said protective coating material is an enamel.

9. A preservation packaging and storage system for packaging, preserving and short or long term storage of ammunition and ammunition related components, according to claim 1, wherein said container has cushioning and insulating sleeve material inserted into said container.

10. A preservation packaging and storage system for packaging, preserving and short or long term storage of ammunition and ammunition related components, according to claim 1, further wherein a top resilient foam cushioned plug with a vent orifice is inserted into said top portion of said container.

11. A preservation packaging and storage system for packaging, preserving and short or long term storage of ammunition and ammunition related components, according to claim 1, further wherein said ammunition is center fire cartridges.

12. A preservation packaging and storage system for packaging, preserving and short or long term storage of ammunition and ammunition related components, according to claim 1, further wherein said ammunition is rim fire cartridges.

13. A preservation packaging and storage system for packaging, preserving and short or long term storage of ammunition and ammunition related components, according to claim 1, further wherein said ammunition is shotgun shells.

14. A preservation packaging and storage system for packaging, preserving and short or long term storage of ammunition and ammunition related components, according to claim 1, further wherein said ammunition is ammunition related components comprising brass, shells, bullets, shot, primers, and gunpowder.

15. A method for preservation packaging and storage for packaging, preserving and short or long term storage of ammunition and ammunition related components, comprising the steps of:

a) providing a cylindrical container, having an inside surface, an outside surface, a top lid portion and a bottom floor portion, wherein said top lid portion includes a pop top container opening mechanism;

b) coating the inside surface and outside surface of said container, including the top lid portion and the bottom floor portion, with a protective coating material;

c) inserting ammunition into said container, thereby generating an ammunition filled container;

d) air evacuating said ammunition filled container; and e) hermetically sealing said ammunition filled air evacuated container.

16. The method of preservation packaging and storage for packaging, preserving and short or long term storage of ammunition and ammunition related components, according to claim 15, including the step wherein said ammunition filled container is placed in a vacuum chamber and evacuated to a negative pressure of about 20-30 inches of mercury.

17. The method of preservation packaging and storage for packaging, preserving and short or long term storage of ammunition and ammunition related components, according to claim 16, including the step wherein said evacuated ammunition filled container is filled with an inert gas.

18. The method of preservation packaging and storage for packaging, preserving and short or long term storage of ammunition and ammunition related components, according to claim 17, wherein said inert gas is nitrogen.

19. The method of preservation packaging and storage for packaging, preserving and short or lone term storage of ammunition and ammunition related components, according to claim 15, wherein said step of coating said inside surface, and said outside surface of said container with a protective coating material, includes coating with enamel.

20. The method of preservation packaging and storage for packaging, preserving and short or long term storage of ammunition and ammunition related components, according to claim 15, wherein said step of coating said top lid portion and said bottom floor portion of said container with a protective coating material, includes coating with enamel.

21. The method of preservation packaging and storage for packaging, preserving and short or long term storage of ammunition and ammunition related components, according to claim 15, wherein said step of providing a container includes providing a metallic can.

22. The method of preservation packaging and storage for packaging, preserving and short or long term storage of ammunition and ammunition related components, according to claim 15, wherein said step of providing a container includes providing a metallic can further includes the step of providing an enamel coated metallic can.

23. The method of preservation packaging and storage for packaging, preserving and short or long term storage of ammunition and ammunition related components, according to claim 15, wherein said step of providing a container includes providing a non-metallic can.

24. The method of preservation packaging and storage for packaging, preserving and short or long term storage of ammunition and ammunition related components, according to claim 15, wherein said step of providing a container includes providing a container having cushioning and insulating sleeve material inserted into said container.

25. The method of preservation packaging and storage for packaging, preserving and short or long term storage of ammunition and ammunition related components, according to claim 15, further wherein a top resilient foam cushioned plug with a vent orifice is inserted into said top portion of said container.

26. The method of preservation packaging and storage for packaging, preserving and short or long term storage of ammunition and ammunition related components, according to claim 15, further wherein said ammunition is center fire cartridges.

27. The method of preservation packaging and storage for packaging, preserving and short or long term storage of ammunition and ammunition related components, according to claim 15, further wherein said ammunition is rim fire cartridges.

28. The method of preservation packaging and storage for packaging, preserving and short or lone term storage of ammunition and ammunition related components, according to claim 15, further wherein said ammunition is shotgun shells.

29. The method of preservation packaging and storage for packaging, preserving and short or long term storage of ammunition and ammunition related components, according to claim 15, further wherein said ammunition is ammunition related components comprising brass, shells, bullets, shot, primers, and gunpowder.

30. The method of preservation packaging and storage for packaging, preserving and short or long term storage of ammunition and ammunition related components, according to claim 15, including the step of inserting a resilient foam cushioned plug at the bottom of said container, and the step of inserting a top resilient foam cushioned plug with a vent orifice into said container.

* * * * *